US007059800B2

(12) United States Patent
Jones et al.

(10) Patent No.: US 7,059,800 B2
(45) Date of Patent: Jun. 13, 2006

(54) METHOD OF REINFORCING AND WATERPROOFING A PAVED SURFACE

(75) Inventors: David R. Jones, Tampa, FL (US); Gregory S. Helwig, Granville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 10/188,447

(22) Filed: Jul. 3, 2002

(65) Prior Publication Data

US 2003/0026654 A1 Feb. 6, 2003

Related U.S. Application Data

(63) Continuation-in-part of application No. 09/795,774, filed on Feb. 28, 2001, now Pat. No. 6,648,547.

(51) Int. Cl.
*E01C 3/06* (2006.01)

(52) U.S. Cl. ..... 404/82; 404/31; 404/72; 404/75

(58) Field of Classification Search ..... 404/82, 404/17, 28, 35, 44, 27, 31, 72, 74, 111, 75
See application file for complete search history.

(56) References Cited

U.S. PATENT DOCUMENTS

| | | | | |
|---|---|---|---|---|
| 2,115,667 A | | 4/1938 | Ellis | |
| 2,811,769 A | * | 11/1957 | Craig | 264/128 |
| 3,311,035 A | | 3/1967 | Poskey et al. | |
| 3,557,671 A | | 1/1971 | Vaslloff | |
| 3,869,417 A | * | 3/1975 | Ramsay | 524/68 |
| 3,932,051 A | | 1/1976 | Cleary | |
| 4,074,948 A | | 2/1978 | Heater, Jr. | |
| 4,151,025 A | | 4/1979 | Jacobs | |
| 4,175,978 A | | 11/1979 | Marzocchi et al. | |
| 4,299,874 A | * | 11/1981 | Jones et al. | 428/143 |
| 4,319,854 A | | 3/1982 | Marzocchi | |
| 4,362,780 A | * | 12/1982 | Marzocchi et al. | 442/85 |
| 4,404,244 A | | 9/1983 | Springston | |
| 4,508,770 A | | 4/1985 | Muncaster et al. | |
| 4,540,311 A | | 9/1985 | Leach | |
| 4,629,358 A | | 12/1986 | Springston | |

(Continued)

FOREIGN PATENT DOCUMENTS

| | | |
|---|---|---|
| DE | 195 43 992 | 5/1997 |

(Continued)

OTHER PUBLICATIONS

TC Mirafi—Technical Data Sheet—Mirafi Mirapave400.

*Primary Examiner*—Raymond Addie
(74) *Attorney, Agent, or Firm*—Inger H. Eckert; James J. Dottavio

(57) ABSTRACT

In a method of reinforcing and waterproofing a paved surface, a layer of liquefied asphalt is applied on a paved surface. A reinforcement mat is then applied over the liquefied asphalt. The reinforcement mat includes a first layer comprising a nonwoven mat produced from fibers selected from the group consisting of mineral fibers, polymer fibers, and mixtures thereof. The reinforcement mat also includes a second layer of mineral fibers attached to the first layer. The liquefied asphalt penetrates and soaks the reinforcement mat to form a water barrier. A layer of paving material is then applied a over the reinforcement mat. The first layer and the second layer of the reinforcement mat are attached to each other by any one of sewing, knitting, needling, heat treating, and adhering with an adhesive, or combinations thereof.

28 Claims, 2 Drawing Sheets

U.S. PATENT DOCUMENTS 4,637,946 A * 1/1987 Shah et al. ..... 428/63
4,699,542 A 10/1987 Shoesmith
4,720,043 A * 1/1988 Ortwein ..... 238/2
4,793,731 A * 12/1988 Gnesa ..... 404/83
4,810,576 A * 3/1989 Gaa et al. ..... 428/391
4,834,577 A * 5/1989 Perfetti ..... 404/82
4,856,930 A 8/1989 Denning
4,957,390 A 9/1990 Shoesmith
5,026,609 A 6/1991 Jacob et al.
5,110,627 A 5/1992 Shoesmith et al.
5,174,228 A * 12/1992 Grimnes ..... 112/475.01
5,246,306 A 9/1993 Shoesmith et al.
5,393,559 A 2/1995 Shoesmith et al.
5,490,961 A 2/1996 Bakhshi et al.
5,494,728 A * 2/1996 Vermilion et al. ..... 428/143
5,521,305 A 5/1996 Huber et al.
5,711,834 A 1/1998 Saito
5,836,715 A 11/1998 Hendrix et al.
5,869,413 A * 2/1999 Gallagher et al. ..... 442/381
5,910,458 A * 6/1999 Beer et al. ..... 442/367
5,941,656 A 8/1999 Sugiyama et al.
6,123,879 A 9/2000 Hendrix et al.
6,235,136 B1 5/2001 Kittson et al.
6,426,309 B1 * 7/2002 Miller et al. ..... 442/148
6,440,529 B1 8/2002 Baumgart et al.
6,503,853 B1 1/2003 Kassner et al.
2002/0155289 A1 * 10/2002 Cistone et al. ..... 428/371

FOREIGN PATENT DOCUMENTS

DK WO 02/35004 A1 * 5/2002
EP 413295 2/1991
FR 2 767 543 2/1999
FR 2 777 577 10/1999
JP 406248609 A 9/1994
JP 406346405 A 12/1994
JP 408013408 A 1/1996
JP 02000027109 A 1/2000
JP 02001234505 A 8/2001
WO WO 02068759 11/2002

* cited by examiner

METHOD OF REINFORCING AND WATERPROOFING A PAVED SURFACE

CROSS REFERENCE TO RELATED APPLICATION

This application is a continuation-in-part of U.S. application Ser. No. 09/795,774, filed Feb. 28, 2001 now U.S. Pat. No. 6,648,547.

TECHNICAL FIELD AND INDUSTRIAL APPLICABILITY OF THE INVENTION

The present invention is related generally to methods of reinforcing and waterproofing paved surfaces such as roads and parking lots, and more particularly to a method which includes the use of a reinforcement mat.

BACKGROUND OF THE INVENTION

Paved surfaces such as roads and parking lots are commonly constructed with a top surface layer of asphalt paving material. Over a period of time, the paved surface usually deteriorates due to the effects of traffic, temperature cycles, and other environmental causes. Cracks develop in the paved surface, and the cracks can spread and cause further deterioration. Water can penetrate the paved surface by flowing into the cracks, causing further damage.

Damaged paved surfaces are usually repaired by applying a new surface layer of paving material over the damaged portions or over the entire paved surface. After a paved surface having cracks is resurfaced, many times the new surface layer cracks directly over the cracks in the old surface. This is known as "reflective cracking." One way to address this problem is to make the new surface layer thicker, but this is not very effective.

Consequently, various reinforcement materials and methods have been tried for preventing or repairing cracks and other deterioration in paved surfaces. One commercial product (an example of which is Petromat® available from BP Amoco) is a reinforcement mat constructed from nonwoven needle-punched polypropylene fibers. The polypropylene mat is applied over a tack coat of asphalt, and then a surface layer of paving material is applied over the mat. The paving material is heated prior to its application over the mat. Unfortunately, the polypropylene mat tends to melt and/or shrink when it is exposed to the hot paving material, which detracts from its ability to provide reinforcement and waterproofing. Additionally, if the tack coat is applied at too high a temperature, the polypropylene mat may likewise shrink or melt.

Various patents describe reinforcement materials and methods of reinforcing paved surfaces. For example, U.S. Pat. No. 2,115,667 to Ellis discloses reinforcing an asphalt road with a reinforcing agent made from woven glass. A woven reinforcement material is usually less porous than a nonwoven material. This impedes the ability of the asphalt to penetrate the reinforcement material to create a strong paved surface. A woven material is also usually more expensive to manufacture than a nonwoven material.

U.S. Pat. No. 4,637,946 to Shah et al. discloses a road repair membrane comprising a glass fiber mat impregnated with a blend of asphalt, block copolymer, and mineral filler. An impregnated mat would not be very effective in soaking up asphalt to create a strong bond with the road. A weakly bonded mat could delaminate from the asphalt layers, enabling the road surface to come apart.

U.S. Pat. No. 6,235,136 to Kittson et al. discloses a water-resistant mastic membrane. The membrane comprises a carrier layer and a grid of glass fibers, both embedded in molten mastic material. The carrier layer is designed to provide only limited performance to the mastic membrane, and can be destroyed, or melted, by the molten mastic material. The membrane is bulky, having a thickness of 50 mm to 150 mm, and consists primarily of mastic material.

In view of the above, it would be desirable to provide an improved method of reinforcing and waterproofing a paved surface, including a method of repairing a defect such as a crack in the paved surface.

SUMMARY OF THE INVENTION

The above object as well as others not specifically enumerated are achieved by a method of reinforcing and waterproofing a paved surface according to the invention. Initially, a layer of liquefied asphalt is applied on a paved surface. A reinforcement mat is then applied over the paved surface. The reinforcement mat includes a first layer comprising a nonwoven mat produced from fibers selected from the group consisting of mineral fibers, polymer fibers, and mixtures thereof. The reinforcement mat also includes a second layer of mineral fibers attached to the first layer. The liquefied asphalt penetrates and soaks the reinforcement mat to form a water barrier. A layer of paving material is then applied over the reinforcement mat. The first layer and the second layer of the reinforcement mat are attached to each other by any one of sewing, knitting, needling, heat treating, and adhering with an adhesive, or combinations thereof.

In one embodiment of the method, the reinforcement mat is applied to the paved surface after the liquefied asphalt is applied to the paved surface.

In another embodiment of the method the reinforcement mat is applied to the paved surface before the liquefied asphalt is applied to the paved surface.

In another embodiment of the method, the second layer of the reinforcement mat comprises continuous strands of glass fiber. The strands of glass fiber are oriented along one direction and are substantially parallel to one another.

In another embodiment of the method, the second layer of the reinforcement mat comprises a randomly-oriented continuous-strand glass fiber mat.

In another embodiment of the method, the second layer of the reinforcement mat comprises randomly-oriented chopped stands of glass fiber.

Another embodiment of the method relates to repairing an elongated crack in a paved surface. A reinforcement mat is applied over the crack by securing the reinforcement mat to the paved surface on one side of the crack and leaving the reinforcement mat unsecured to the paved surface on the opposite side of the crack. In a preferred embodiment of the repair method, the reinforcement mat includes a first layer comprising a nonwoven mat produced from fibers selected from the group consisting of mineral fibers, polymer fibers, and mixtures thereof. The reinforcement mat also includes a second layer of mineral fibers attached to the first layer. A layer of paving material is then applied over the reinforcement mat. The first layer and the second layer of the reinforcement mat are attached to each other by any one of sewing, knitting, needling, heat treating, and adhering with an adhesive, or combinations thereof.

Various objects and advantages of this invention will become apparent to those skilled in the art from the following detailed description of the preferred embodiments, when read in light of the accompanying drawings.

DETAILED DESCRIPTION AND PREFERRED EMBODIMENTS OF THE INVENTION

The present invention relates to an improved method of reinforcing and waterproofing a paved surface such as a road, a parking lot, or any other type of paved surface. The method can be used in the construction of a new paved surface, in the rejuvenation of an existing paved surface, or to repair a crack, pothole, or other defect in an existing paved surface.

Figure 1:
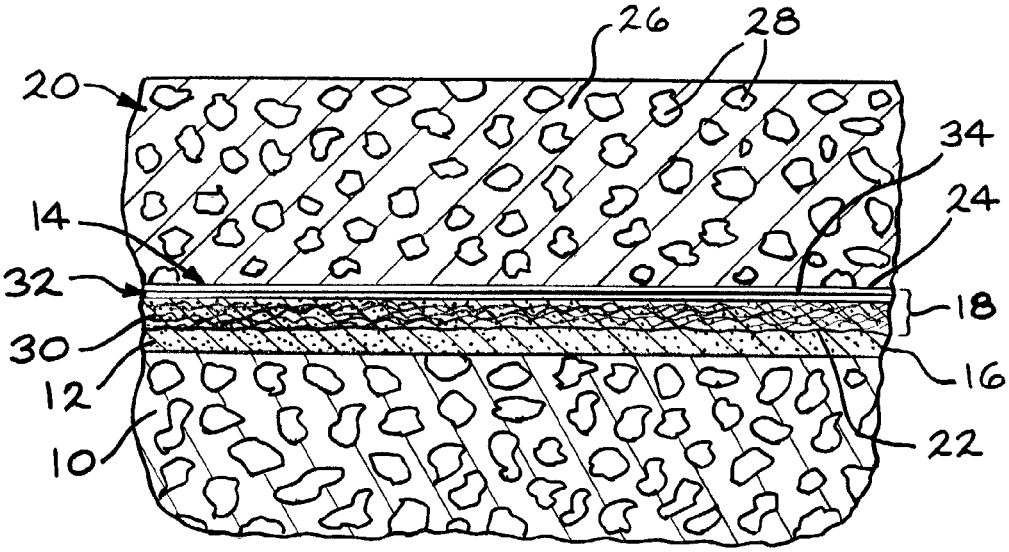
FIG. 1 is a cross-sectional view in elevation of a paved surface which is reinforced and waterproofed according to the method of the invention.

Referring now to the drawings, FIG. 1 shows a paved surface 10 which is reinforced and waterproofed according to the method of the invention. A first step of the method is to apply a layer of liquefied asphalt 12 on the paved surface 10. The liquefied asphalt 12 can be any type of bituminous material which is fluid at the time of application but which is able to firm up after application. For example, the liquefied asphalt can be a molten asphalt; e.g., asphalt heated to a temperature above about 250° F. (121° C.), an asphalt emulsion (typically asphalt dispersed in water with an emulsifier), or an asphalt cutback (typically asphalt diluted with a solvent to make the asphalt fluid).

The layer of liquefied asphalt 12 can be applied in any amount which is suitable for penetrating and soaking the reinforcement mat 14, described below. Preferably, the liquefied asphalt is applied at a rate within a range of from about 0.1 gallon/square yard (0.32 liter/square meter) to about 0.5 gallon/square yard (1.58 liter/square meter), the optimum rate depending on the weight of the reinforcement mat. The liquefied asphalt can be applied by any suitable method, such as by spraying it as a layer or by pouring and spreading it into a layer.

A second step of the method is to apply the reinforcement mat 14 over the liquefied asphalt 12, while the liquefied asphalt is still in the fluid condition. The reinforcement mat 14 is sufficiently porous such that the liquefied asphalt penetrates and soaks the reinforcement mat 14. In the embodiment shown, the layer of liquefied asphalt 12 includes a bottom portion 16 below the reinforcement mat 14 and a top portion 18 which saturates the reinforcement mat 14. However, the liquefied asphalt could also be located entirely inside the reinforcement mat after it is applied. Preferably, the reinforcement mat can absorb at least about 0.1 gallon/square yard (0.32 liter/square meter) of the liquefied asphalt.

A sufficient amount of liquefied asphalt 12 is applied, and the reinforcement mat 14 absorbs enough liquefied asphalt, to form a strong bond with the paved surface 10 and with the layer of paving material 20, described below. The reinforcement mat 14 also forms a water barrier that prevents water from penetrating into the paved surface from above. Preferably, the reinforcement mat 14 is substantially completely saturated with the liquefied asphalt, such that the liquefied asphalt penetrates from a bottom surface 22 to a top surface 24 of the reinforcement mat 14.

Figure 2:
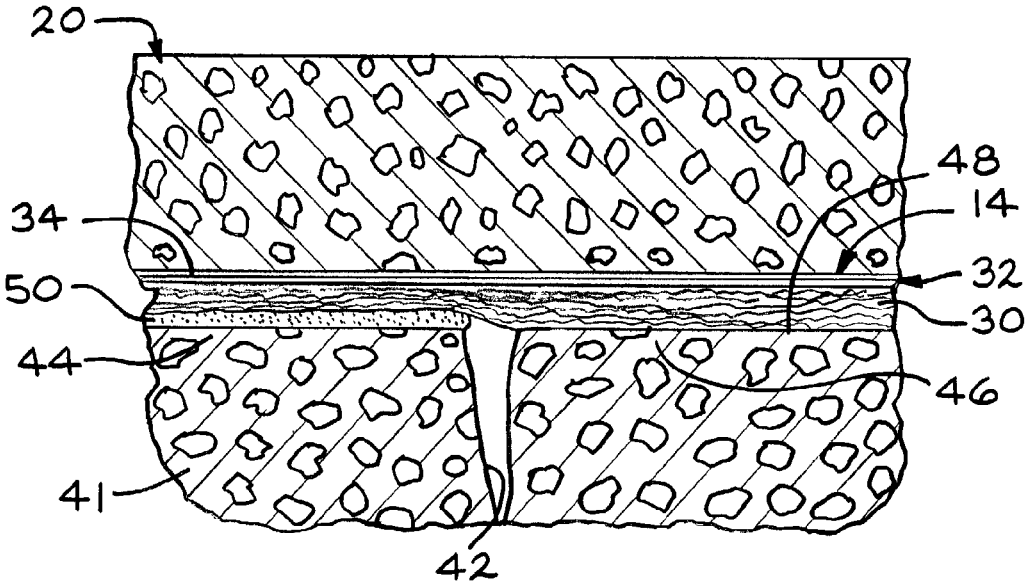
FIG. 2 is a cross-sectional view in elevation of a paved surface having a crack which is repaired according to the method of the invention.

As shown in FIGS. 1 and 2, the reinforcement mat 14 includes a first layer 30 and a second layer 32. The first layer 30 is a nonwoven fibrous mat made from mineral fibers such as glass fibers, polymer fibers, or mixtures thereof. Preferably, the first layer is a nonwoven fibrous mat as disclosed in U.S. patent application Ser. No. 09/795,774, filed Feb. 28, 2001, owned by the assignee of this invention, and incorporated herein by reference.

Figure 3:
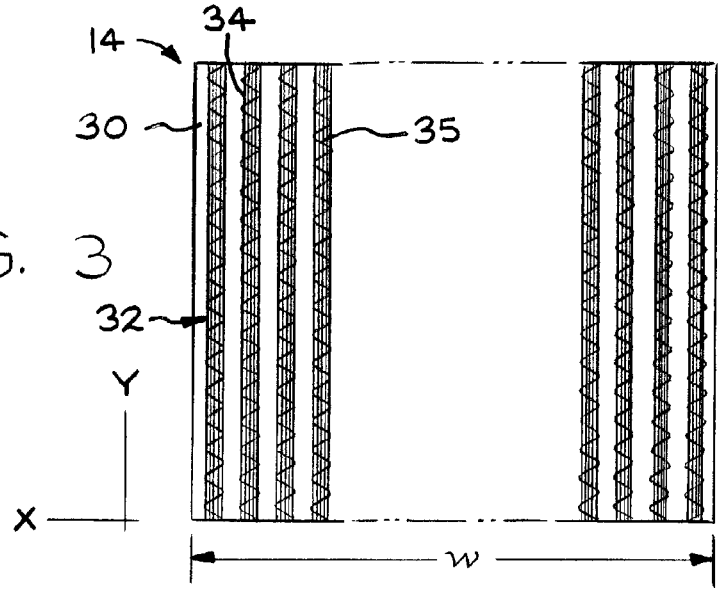
FIG. 3 is a plan view of a first embodiment of a reinforcement mat illustrated in FIGS. 1 and 2 showing a second layer of continuous strands of glass fiber.

In a first embodiment, the first layer 30 of the reinforcement mat 14 is made of glass fibers, and has a width w, as shown in FIG. 3. Such a glass fiber mat is thermally stable, and does not melt and/or shrink when it is exposed to hot paving material. At the levels of strain encountered in the movement of pavements, the glass fiber mat comprising the first layer 30 carries much higher tensile loads than the polypropylene mats typically used. Preferably, the glass fiber mat has a basis weight within a range of from about 0.5 to about 10 pounds per hundred square feet (about 0.02 $kg/m^2$ to about 0.42 $kg/m^2$), and more preferably from about 1 to about 5 pounds per hundred square feet (about 0.04 $kg/m^2$ to about 0.21 $kg/m^2$).

A first embodiment of the second layer is generally shown at 32 in FIG. 3. The second layer 32 includes a plurality of continuous strands 34 of glass fibers disposed on a surface of the first layer 30. The strands 34 can be oriented in a desired direction relative to the first layer 30, and relative to one another. Preferably, the strands 34 are oriented along one direction, and are substantially parallel to one another, as shown in FIG. 3. The strands 34 can also be oriented in any desired direction relative to the first layer 30 and relative to one another. The orientation as shown in FIG. 3 is preferred for reasons that will be explained in detail below.

Adjacent parallel strands 34 can be spaced at any desired distance relative to one another. Preferably, the strands 34 are spaced within the range of about 0.5 to about 12 strands per inch of width w (19.7 to 472 strands/meter of width w) of the first layer 30. More preferably, the strands 34 are spaced at about 2.0 strands per inch of width w (78.8 strands/meter of width w) of the first layer 30.

Each bundle 34 can contain any desired amount of filaments of glass fibers. The strands 34 preferably have a yield within the range of from about 100 to about 1000 yards per pound (202 to 2020 meters/kilogram) of glass, which is equivalent to a linear density within the range of from about 4960 tex to about 496 tex. More preferably, the strands 34 have a yield within the range of from about 200 to about 450 yards per pound (403 to 907 meters/kilogram) of glass which is equivalent to a linear density within the range of from about 2480 tex to about 1100 tex. Additionally, the second layer 32 preferably has a basis weight within the range of from about 0.5 to about 15 ounces per square yard (17 to 512 grams/square meter) of reinforcement mat 14. More preferably, the second layer 32 has a basis weight within the range of from about 4.5 to about 6.5 ounces per square yard (153 to 220 grams/square meter) of reinforcement mat 14.

The strands 34 comprising the second layer 32 can be attached to the first layer 30 by any desired method. Knitting, as shown in FIG. 3, is a preferred method of attaching the strands 34 to the first layer 30. As used herein, knitting is defined as a method of attaching by interlacing yam or thread 35 in a series of connected loops with needles. The strands 34 can also be attached to the first layer 30 by other methods, such as, for example, sewing, needling, heat treating, adhering with an adhesive, or any combination thereof. The thread 35 can be any desired natural or synthetic material. Preferably the thread 35 is synthetic. More preferably, the thread 35 is polyester or nylon because of the relatively high melting temperatures of both polyester and nylon.

Figure 4:
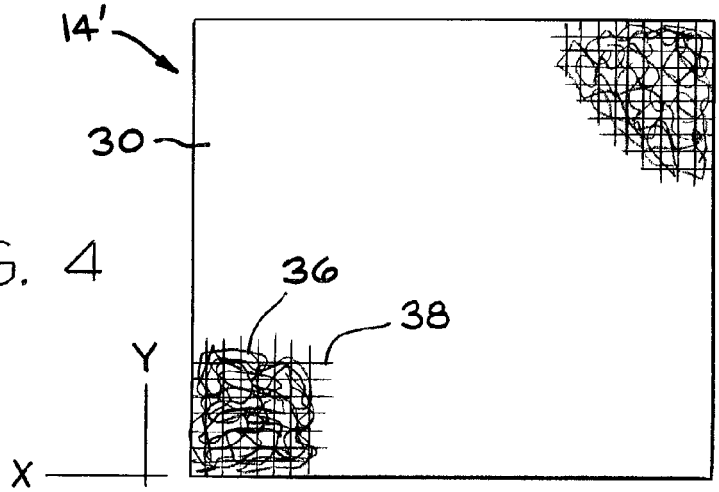
FIG. 4 is a plan view of a second embodiment of the reinforcement mat illustrated in FIGS. 1 and 2 showing a second layer of randomly-oriented continuous-strand glass fiber mat.

A second embodiment of the reinforcement mat is generally shown at 14' in FIG. 4. The reinforcement mat 14' includes the first layer 30, and a second layer 36. The second layer 36 is formed from a randomly-oriented continuous strand of glass fiber applied to a surface of the first layer 30 by any conventional method. The layer 36 formed from the continuous strand of glass fiber is commonly known as a continuous filament mat (CFM). The second layer 36 can have any desired basis weight. Preferably, the second layer 36 has a basis weight within the range of from about 4.5 to about 45 ounces per square yard (154 to 1535 grams/square meter) of reinforcement mat 14. More preferably, the second layer 36 has a basis weight within the range of from about 9.0 to about 18 ounces per square yard (307 to 614 grams/square meter) of reinforcement mat 14.

The second layer 36 can be attached to the first layer 30 by any desired method. Knitting is a preferred method of attaching the second layer 36 to the first layer 30, as described above for attaching the second layer 32 to the first layer 30. As shown in FIG. 4, threads 38 attach the second layer 36 to the first layer 30 in a series of connected loops.

Figure 5:
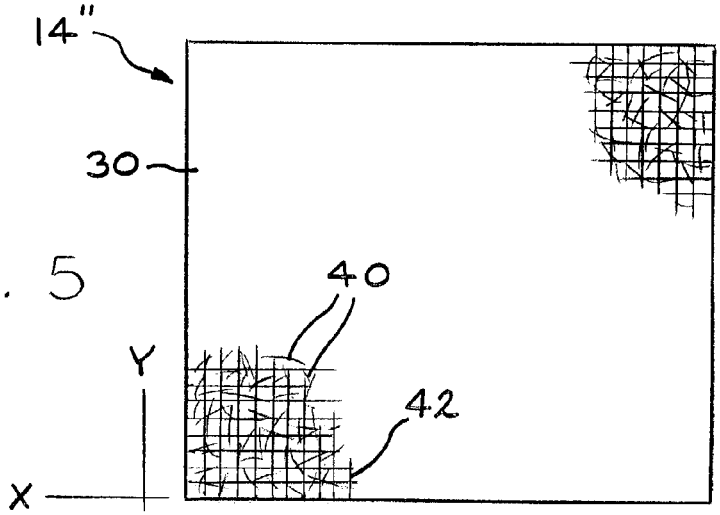
FIG. 5 is a plan view of a third embodiment of the reinforcement mat illustrated in FIGS. 1 and 2 showing a second layer of randomly-oriented chopped strands of glass fiber.

A third embodiment of the reinforcement mat is generally shown at 14" in FIG. 5. The reinforcement mat 14" includes the first layer 30, and a second layer 40. The second layer 40 is formed from randomly-oriented chopped strands of glass fiber applied to a surface of the first layer 30 by any conventional method. The random orientation of the chopped strands of the layer 40 provide improved strength to the reinforcement mat 14 in a first, x, dimension and a second, y, dimension. The second layer 40 can include chopped strands of any desired length. Preferably, the chopped strands have a length within the range of from about 0.5 to about 8.0 inches (0.013 to 0.20 meters). More preferably, the chopped stands have a length within the range of from about 2.0 to about 4.0 inches (0.05 to 0.1 meters). Most preferably, the chopped stands have a length of about 2.0 inches (0.05 meters).

The second layer 40 can have any desired basis weight. Preferably, the second layer 40 has a has a basis weight within the range of from about 0.5 to about 15 ounces per square yard (17 to 512 grams/square meter) of reinforcement mat 14. More preferably, the second layer 40 has a basis weight within the range of from about 5.0 to about 8.0 ounces per square yard (171 to 273 grams/square meter) of reinforcement mat 14. The second layer 40 can be attached to the first layer 30 by any desired method. Knitting is a preferred method of attaching the second layer 40 to the first layer 30, as described above for attaching the second layer 32 and 36 to the first layer 30. As shown in FIG. 5, threads 42 attach the second layer 40 to the first layer 30 in a series of connected loops.

The reinforcement mat 14, 14', and 14" can be wrapped in a continuous roll, although a continuous roll is not required. Preferably, such a continuous roll has a width within a range of from about 5 feet (1.52 meters) to about 20 feet (6.1 meters). The continuous roll may also have any desired width. The reinforcement mat 14, 14', and 14" is applied over the liquefied asphalt by unrolling the reinforcement mat 14, 14', and 14" from the roll onto the liquefied asphalt.

The liquefied asphalt is allowed to become firm, or at least partially solidify, at some time after the application of the reinforcement mat. Usually, the liquefied asphalt is allowed to become firm before the application of the paving material described below. For example, molten asphalt can be allowed to become firm by cooling, asphalt emulsion can be allowed to become firm by the evaporation of water, and cutback asphalt can be allowed to become firm by the evaporation of solvent. The open porosity of the first layer 30 of the reinforcement mat 14 facilitates the evaporation of water or solvent.

A third step of the method is to apply a layer of paving material 20 over the reinforcement mat 14, 14', and 14". The paving material 20 can be any material suitable for providing a top surface layer of a paved surface, such as an asphalt paving material, typically a mixture of asphalt 26 and aggregate 28, or a concrete paving material. The paving material is usually applied in a heated condition, and then allowed to cool. When the heated paving material is applied over the reinforcement mat the heat of the mix partially liquefies the asphalt in the reinforcement layer, drawing it up into the mat, and forming a monolithic waterproof bond with the overlying pavement layer. It is during this heating step (that is unavoidable when placing an asphalt paving mixture over the mat) that damage from melting and shrinking can occur with polypropylene mats.

When the reinforcement of the paved surface is completed, the penetration of the reinforcement mat by the liquefied asphalt 12 (now at least partially solidified) forms a strong bond between the reinforcement mat 14, 14', and 14", the asphalt 12, the paved surface 10, and the layer of paving material 20. This creates a strong, monolithic paved surface structure that is very resistant to damage. The high tensile and mechanical strength of the reinforcement mat 14, 14', and 14" provides mechanical reinforcement to the paved surface. Additionally, the penetration of the reinforcement mat by the asphalt forms a water barrier or waterproof membrane that prevents water from penetrating into the paved surface from above and causing damage.

In a fourth embodiment of the invention (not illustrated), the method comprises pavement of a non-paved surface by applying the liquefied asphalt on a prepared unpaved surface, applying the reinforcement mat over the liquefied asphalt and the prepared unpaved surface, and applying the paving material over the reinforcement mat 14, 14', and 14".

As mentioned above, the method of the invention can be used in the construction of a new paved surface, in the rejuvenation of an existing paved surface, or to repair cracks, potholes or other defects in an existing paved surface. When repairing a defect in a paved surface, a first step of the method is to apply a layer of liquefied asphalt on a paved surface having a defect. When the defect is a crack in the paved surface, the liquefied asphalt may be applied over the crack without initial preparation of the crack, or alternatively the crack may be filled with an appropriate crack filler such as those meeting the requirements of ASTM D-3405 or D-1190 or other suitable material. When the defect is a pothole in the paved surface, typically the pothole is initially filled with a material conventionally used for filling potholes, such as an asphalt paving material. Then the liquefied asphalt is applied over the filled pothole. Badly broken or rough pavement may require milling or placement of a leveling course before application of the liquefied asphalt. The reinforcement mat is then applied over the liquefied asphalt and the defect. Finally, a layer of paving material is applied over the reinforcement mat and the defect. When the repair is completed, the reinforcement mat forms a strong bond with the paved surface and holds the paved surface around the defect together. The reinforcement mat prevents water from penetrating into the defect from above and causing further damage.

In a fifth embodiment, the invention relates to a method of repairing a crack in a paved surface. FIG. 2 shows a paved surface 41 having a crack 42 which is repaired according to this method. The paved surface 41 includes a first surface portion 44 on one side of the crack (the left side as viewed in FIG. 2), and a second surface portion 46 on the opposite side of the crack (the right side as viewed in FIG. 2). In the illustrated embodiment, the first surface portion 44 is adjacent a first longitudinal side of the crack 42 and the second surface portion 46 is adjacent a second longitudinal side of the crack 42.

In this repair method, a desired reinforcement mat is applied over the crack 42. Preferably, the reinforcement mat 14 is used. However, any desired reinforcement mat, such as reinforcement mat 14' and 14" may also be used. Unlike the embodiments of the invention described above, in this repair method it is preferred that the reinforcement mat 14 is saturated with asphalt before it is applied to a road surface. The reinforcement mat 14 is secured to the first surface portion 44 of the paved surface 41 on the one side of the crack 42, but the reinforcement mat 14 is left unsecured to the second surface portion 46 of the paved surface 41 on the opposite side of the crack 42.

Then, a layer of paving material 20 is applied over the reinforcement mat 14. Securing the reinforcement mat 14 to the paved surface 41 on only one side of the crack 42 reduces the occurrence of reflective cracking by leaving a slip plane or energy dissipation area 48 between the reinforcement mat 14 and the second surface portion 46 of the paved surface 41. The slip plane 48 is defined as the area where a bottom surface of the reinforcement mat 14 contacts the paved surface 41. As the paved surface 41 surrounding the crack 42 is caused to move over time, the slip plane 48 allows the second surface portion 46 to move relative to the reinforcement mat 14 without the movement of the second surface portion 46 being reflected to the newly applied layer of paving material 20 and thereby creating a crack in the paving material 20.

The reinforcement mat can be secured to the paved surface on one side of the crack by any suitable method. In the embodiment shown in FIG. 2, an adhesive 50 is applied to the first surface portion 44 of the paved surface 41 adjacent the crack 42 thereby adhering the reinforcement mat 14 to the first surface portion 44. Any suitable adhesive can be used, such as molten asphalt or a polymeric adhesive.

In another embodiment (not shown), the adhesive is first applied to the reinforcement mat, and the reinforcement mat having the adhesive is then applied to the paved surface. In another embodiment (not shown), the reinforcement mat is secured to the paved surface by first applying a pressure sensitive adhesive to the reinforcement mat, and then pressing the reinforcement mat against the paved surface. In a further embodiment (not shown), the reinforcement mat is secured to the paved surface by first applying a self-activated adhesive to the reinforcement mat, and applying the reinforcement mat to the paved surface in a manner which activates the adhesive. For example, the self-activated adhesive may be a heat-activated adhesive which is activated when the layer of heated paving material is applied over the reinforcement mat. Alternatively, the reinforcement mat may comprise other known materials adhered to a single side of the crack.

As described in the paper entitled "A study of grid reinforced asphalt to combat reflection cracking," by S. F. Brown et al., the crack-causing strain in an asphalt road surface is generally perpendicular or transverse to a crack formed in a road surface. Surprisingly, it has been discovered that by attaching the second layer 32 having the strands 34 parallel to the direction of vehicular travel, and positioning the strands 34 transverse to an elongated crack to be repaired, the occurrence of reflective cracking is substantially eliminated. As is known, cracks in road surfaces are often not elongated, are often irregularly shaped, and can extend in multiple directions. It has also been discovered that when the reinforcement mat 14' and 14", formed by attaching the second layers 36 and 40, respectively, to the first layer 30, is used to repair such an irregular crack, the occurrence of reflective cracking is substantially reduced.

The principle and mode of operation of this invention have been described in its preferred embodiments. However, it should be noted that this invention may be practiced otherwise than as specifically illustrated and described without departing from its scope. For example, while the method of the invention has been illustrated in terms of reinforcing a new or rejuvenated paved surface, and repairing a crack in a paved surface, the method can also be used for repairing other defects such as potholes in paved surfaces. The drawings show a particular type and size of reinforcement mat, but other types and sizes of reinforcement mat can also be used. The drawings also show particular types and amounts of liquefied asphalt and paving material, but it is recognized that other types and amounts of liquefied asphalt and paving material can be used in the invention.

What is claimed is:

1. A method of reinforcing and waterproofing a paved surface comprising the steps of:

applying a layer of liquefied asphalt on a surface;

applying a reinforcement mat over the surface, the reinforcement mat not defining a water barrier and having a first layer comprising a nonwoven mat produced from fibers selected from the group consisting of mineral fibers, polymer fibers, and mixtures thereof, and a second layer of mineral fibers attached to the first layer, the liquefied asphalt of the layer of liquefied asphalt penetrating and soaking the reinforcement mat to form a water barrier, the reinforcement mat being sufficiently porous such that it can absorb at least 0.1 gallon/square yard of the liquefied asphalt; and applying a layer of paving material over the reinforcement mat.

2. The method according to claim 1, wherein the step of applying the reinforcement mat occurs after the step of applying the layer of liquefied asphalt.

3. The method according to claim 1, wherein the second layer of the reinforcement mat comprises glass fibers.

4. The method according to claim 1, wherein the fibers of the first layer include at least about 5% by weight polymer fibers selected from the group consisting of polyester fibers, nylon fibers, and mixtures thereof.

5. The method according to claim 1, wherein the second layer of the reinforcement mat comprises a mat of randomly-oriented chopped strands of glass fiber.

6. The method according to claim 1, wherein the second layer of the reinforcement mat comprises continuous strands of glass fiber.

7. The method according to claim 6, wherein the continuous strands have a yield within the range of from about 100 to about 1000 yards per pound (about 202 to about 2020 meters per kilogram) of glass fiber.

8. The method according to claim 6, wherein the second layer of the reinforcement mat has a weight within the range of from about 0.5 ounces per square yard to about 15 ounces per square yard (about 17 grams per square meter to about 512 grams per square meter).

9. The method according to claim 6, wherein the strands of the second layer of the reinforcement mat are spaced within the range of from about 0.5 strands per inch of width of the first layer to about 12 strands per inch of width of the first layer (about 19.7 strands per meter of width of the first layer to about 472 strands per meter of width of the first layer).

10. The method according to claim 6, wherein the continuous strands of the second layer are oriented along one direction.

11. The method according to claim 10, wherein the continuous strands of the second layer are substantially parallel to one another.

12. The method according to claim 6, wherein the second layer comprises a randomly-oriented continuous-strand glass fiber mat.

13. The method according to claim 12, wherein the second layer of the reinforcement mat has a basis weight within the range of from about 4.5 ounces per square yard to about 45 ounces per square yard (154 grams per square meter to about 1535 grams per square meter) of reinforcement mat.

14. The method according to claim 1, wherein the first layer and the second layer of the reinforcement mat are attached to each other by any one of sewing, knitting, needling, heat treating, and adhering with an adhesive, or combinations thereof.

15. The method according to claim 1, wherein the amount of mineral fiber in the first layer of the reinforcement mat is within the range of from about 20 to about 100 weight percent.

16. The method according to claim 15, wherein the mineral fibers are glass fibers.

17. The method according to claim 1, wherein the second layer of the reinforcement mat comprises randomly-oriented chopped strands of glass fiber having a length within the range of from about 0.5 inches to about 8.0 inches (about 0.013 meters to about 0.20 meters).

18. The method according to claim 17, wherein the second layer of the reinforcement mat has a basis weight within the range of from about 0.5 ounces per square yard to about 15.0 ounces per square yard (about 17 grams per square meter to about 512 grams per square meter).

19. A method of reinforcing and waterproofing a paved surface comprising the steps of:

applying a layer of liquefied asphalt on a surface;

applying a reinforcement mat over the liquefied asphalt of the layer of liquefied asphalt, the reinforcement mat not defining a water barrier and having a first layer comprising a nonwoven mat produced from fibers selected from the group consisting of mineral fibers, polymer fibers, and mixtures thereof, and a second layer comprising a randomly-oriented continuous-strand glass fiber mat, the second layer being attached to the first layer, the liquefied asphalt penetrating and soaking the reinforcement mat to form a water barrier, the reinforcement mat being sufficiently porous such that it can absorb at least 0.1 gallon/square yard of the liquefied asphalt; and applying a layer of paving material over the reinforcement mat.

20. The method according to claim 19, wherein the first layer and the second layer of the reinforcement mat are attached to each other by any one of sewing, knitting, needling, heat treating, and adhering with an adhesive, or combinations thereof.

21. A method of reinforcing and waterproofing a paved surface comprising the steps of:

applying a layer of liquefied asphalt on a surface;

applying a reinforcement mat over the liquefied asphalt of the layer of liquefied asphalt, the reinforcement mat not defining a water barrier and having a first layer comprising a nonwoven mat produced from fibers selected from the group consisting of mineral fibers, polymer fibers, and mixtures thereof, and a second layer comprising randomly-oriented chopped strands of glass fiber, the second layer being attached to the first layer, the liquefied asphalt penetrating and soaking the reinforcement mat to form a water barrier, the reinforcement mat being sufficiently porous such that it can absorb at least 0.1 gallon/square yard of the liquefied asphalt; and applying a layer of paving material over the reinforcement mat.

22. The method according to claim 21, wherein the first layer and the second layer of the reinforcement mat are attached to each other by any one of sewing, knitting, needling, heat treating, and adhering with an adhesive, or combinations thereof.

23. A method of reinforcing and waterproofing a paved surface comprising the steps of:

applying a layer of liquefied asphalt on a surface;

applying a reinforcement mat over the liquefied asphalt of the layer of liquefied asphalt, the reinforcement mat not defining a water barrier and having a first layer comprising a nonwoven mat produced from fibers selected from the group consisting of mineral fibers, polymer fibers, and mixtures thereof, and a second layer comprising continuous strands of glass fiber, the second layer being attached to the first layer, the liquefied asphalt penetrating and soaking the reinforcement mat to form a water barrier, the reinforcement mat being sufficiently porous such that it can absorb at least 0.1 gallon/square yard of the liquefied asphalt; and applying a layer of paving material over the reinforcement mat.

24. The method according to claim 23, wherein the first layer and the second layer of the reinforcement mat are attached to each other by any one of sewing, knitting, needling, heat treating, and adhering with an adhesive, or combinations thereof.

25. The method of reinforcing and waterproofing a paved surface according to claim 1, wherein the mat is sufficiently porous to absorb about 0.1 gallon/yd$^2$.

26. The method of reinforcing and waterproofing a paved surface according to claim 19, wherein the mat is sufficiently porous to absorb about 0.1 gallon/yd$^2$.

27. The method of reinforcing and waterproofing a paved surface according to claim 21, wherein the mat is sufficiently porous to absorb about 0.1 gallon/yd$^2$.

28. The method of reinforcing and waterproofing a paved surface according to claim 23, wherein the mat is sufficiently porous to absorb about 0.1 gallon/yd$^2$.

* * * * *